United States Patent [19]

Castle et al.

[11] Patent Number: 4,490,999

[45] Date of Patent: Jan. 1, 1985

[54] DOOR LOCK WITH INDICATOR

[76] Inventors: Nial K. Castle, 4149 Cartagena Dr., San Diego, Calif. 92115; Derald E. Martin, 6864 Cedral Pl., Lemon Grove, Calif. 92045; Ralph D. Martin, 8858 Harness St., Spring Valley, Calif. 92077

[21] Appl. No.: 424,223

[22] Filed: Sep. 27, 1982

[51] Int. Cl.[3] ..... E05B 41/00

[52] U.S. Cl. ..... 70/432; 70/330

[58] Field of Search ..... 70/432, 330; 49/13; 40/460, 492

[56] References Cited

U.S. PATENT DOCUMENTS

| | | | |
|---|---|---|---|
| 747,252 | 12/1903 | Smith | 40/460 |
| 943,637 | 12/1909 | Schoell | 70/432 |
| 999,044 | 7/1911 | Kuster | 70/432 |
| 1,216,899 | 2/1917 | Weyer | 40/460 |
| 1,337,401 | 4/1920 | Heberling | 40/460 |
| 1,362,647 | 12/1920 | Stone | 70/432 |
| 2,565,669 | 8/1951 | Smith | 70/432 |

*Primary Examiner*—Robert L. Wolfe

*Attorney, Agent, or Firm*—Brown, Martin & Haller

[57] ABSTRACT

A self-contained door lock with an indicating device visible on the inside surface of a door that can be provided as an adaptor for existing door locks or manufactured as part of the original door lock. The indicating device automatically gives a visible indication at the lock location as to whether the door lock is locked or unlocked. The indicating device automatically works in coordination with the door lock mechanism.

5 Claims, 12 Drawing Figures

DOOR LOCK WITH INDICATOR

BACKGROUND OF THE INVENTION

The present invention relates to a door lock indicating device. It is desirable from a convenience standpoint and also from a safety standpoint to have an indication on the inside surface of a door as to whether it is locked or unlocked. When people are closing up a house to leave it, there is no way to tell whether the door is locked or unlocked without turning the doorknob and testing it. This is inconvenient and irritating when a person is in a hurry and has several doors to check. In addition, an increasing number of fire and safety departments are coming to realize that such an indication is important from a safety standpoint. People often panic and become confused in an emergency situation within a building. In attempting to leave through a door, a person may accidentially lock the door thinking that he is unlocking it. Some states have enacted laws concerning this problem.

Although the need for a door lock indicating device is recognized, there is an objection to such an indicating device which detracts from the appearance of the door or that requires extensive modification of the door itself.

It is a primary object of the present invention to provide a new and improved door lock indicating device that is simple in construction and efficient in use and that does not require an alteration of the door that detracts from its appearance.

It is another object of the present invention to provide a new and improved door lock indicating device that can be readily used to adapt existing door locks to provide an indication of the position of the door lock or that can be manufactured as part of the original door lock construction.

It is another object of the present invention to provide such a new and improved door lock indicating device that can be manufactured at a practical cost.

SUMMARY OF THE INVENTION

The above objects are attained by an exemplary embodiment of the present invention that is a self-contained arrangement including indicating means that automatically indicate the locked condition of the door lock when the actuating means of the door lock is turned to one position and that automatically indicate the unlocked condition of the door lock when the actuating means is turned to another position.

DETAILED DESCRIPTION OF THE INVENTION

Figure 1:
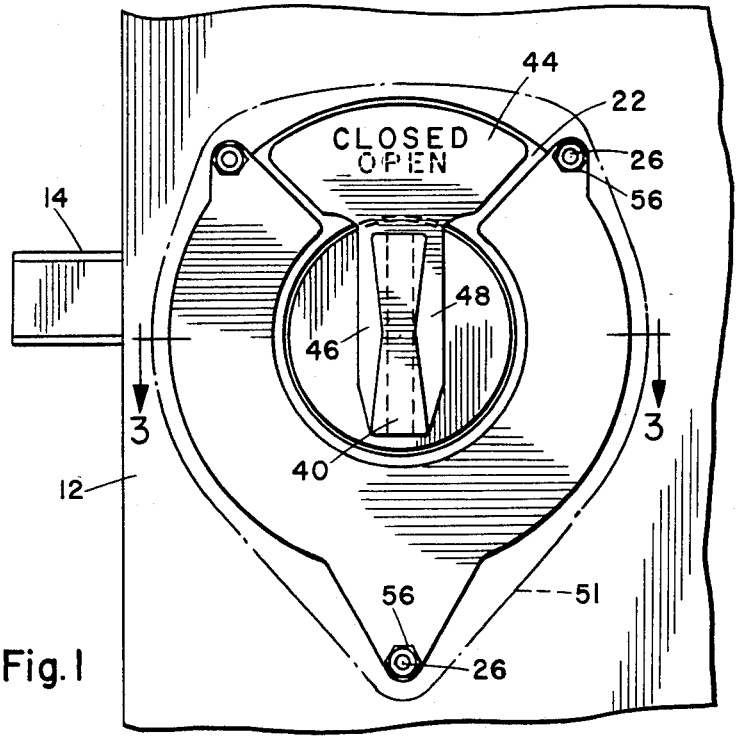
FIG. 1 is a side elevation view of one form of the indicator mounted on a lock.
Figure 2:
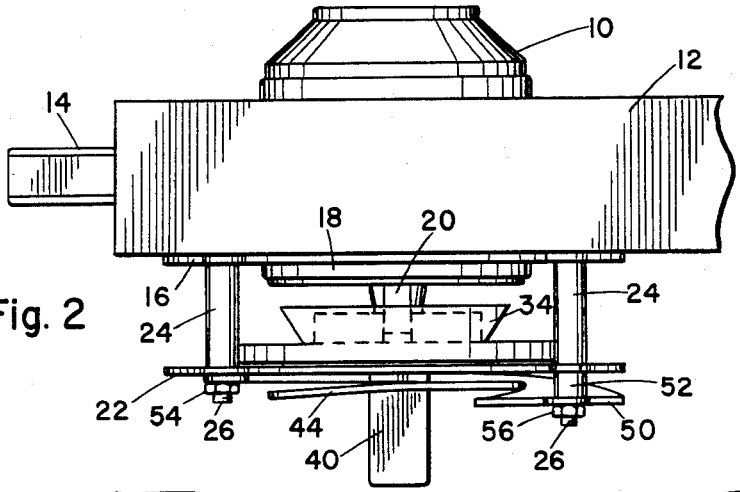
FIG. 2 is a top plan view of the structure.
Figure 3:
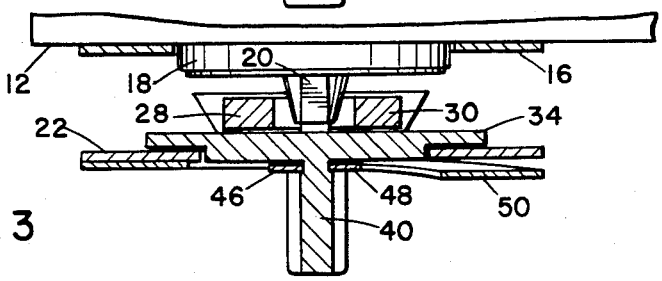
FIG. 3 is a sectional view taken on line 3—3 of FIG. 1.
Figure 4:
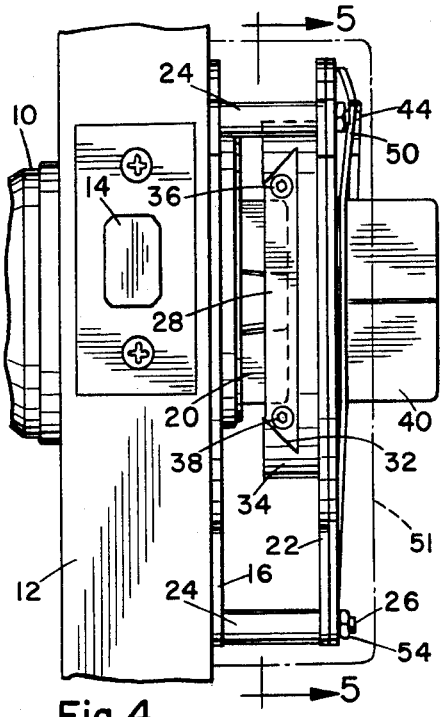
FIG. 4 is an end view as taken from the left hand side of FIG. 1.
Figure 5:
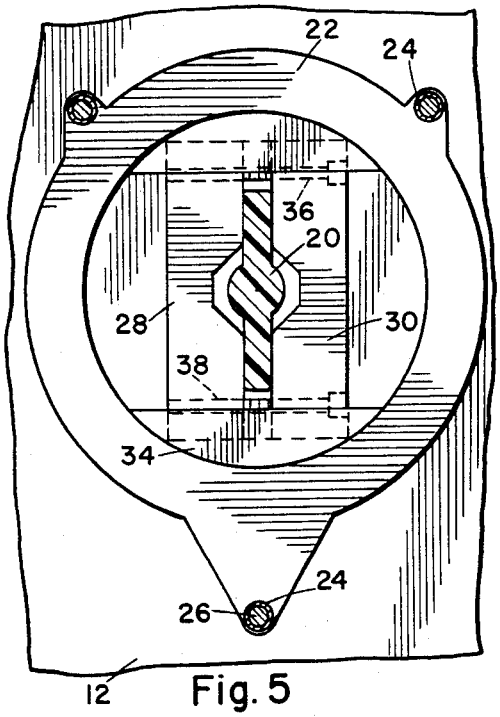
FIG. 5 is a sectional view taken on line 5—5 of FIG. 4.
Figure 6:
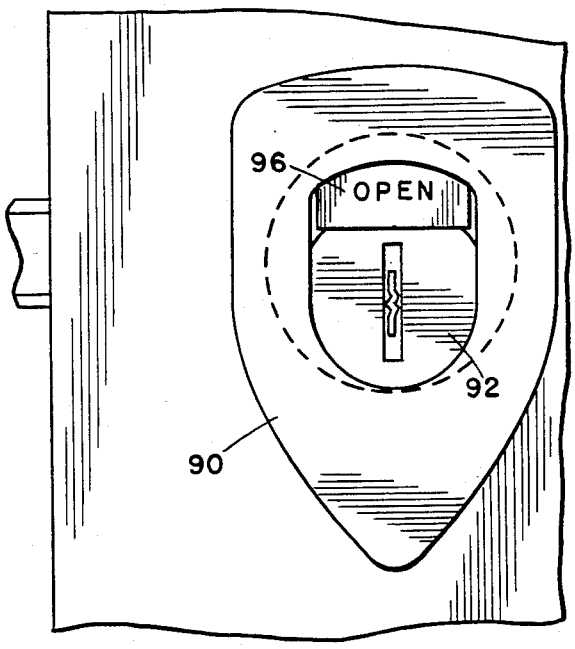
FIG. 6 is a side elevation view of an alternative form of indicator.

The first embodiment of the present invention is shown in FIGS. 1-5 of the drawings. This embodiment connects a conventional thumb turn to a key terminal. The lock mechanism is indicated generally at 10 and is positioned on a door 12. The lock actuates a locking bar 14 in and out of a female lock depression in the door jamb (not shown). This device comprises an attachment assembly that is mounted on the inside surface of the door 12. It includes a back plate 16 screwed to the door by screws (not shown). The back plate 16 surrounds the lock palte 18 and the lock thumb turn 20 that extends from the door lock 10. An indicator plate 22 is held in spaced relationship to the back plate 16 by spacers 24 extending over threaded studs 26. The legend "open" is imprinted on the indicator plate 22. A pair of clamp members 28 and 30 are positioned over the lock thumb turn 20 of the lock mechanism 10. These clamp members 28 and 30 ride in a transverse tapered slot 32 in seating member 34 (FIG. 4). These clamp members 28 and 30 can slide in the slot 32 until they are properly aligned and seated to clamp the lock thumb turn 20 to the indicator assembly. Once in the proper location, screws 36 and 38 secure the clamp members 28 and 30 together. The seating member 34 includes an actuating bar 40 extending therefrom through a central opening in indicator plate 22.

A flag 44 with the indication "closed" imprinted thereon has legs 46 and 48 positioned one on each side of the actuating bar 40. A cover plate 50 is located over the indicator plate 22. A spacer 52 is positioned on one screw 26 so that the cover plate 50 is canted and the flag 44 can slide behind the cover plate 50. Nuts 54 hold the cover plate 50 in position.

When the key is inserted into the outside of the lock 10 and rotated to the locked position or when the actuating bar 40 is rotated to the locked position, the locking bar 14 is moved out of the door 12 into the locked position. When this occurs, the flag 44 is rotated couterclockwise and ends up in the position shown in FIG. 1 with the "closed" legend on the flag 44 overlying the "open" legend on indicator plate 22. Rotation of the key or actuating bar 40 clockwise in FIG. 1 moves the flag 44 away from the "open" legend on the indicator plate 22 giving a visual indication that the door is unlocked. Thus, there is a plain, readily visible indication on the inside of the door of the condition of the door lock. A cover is indicated in broken line at 51. The cover plate fits over the assembly and has an open window for viewing the indicia to determine whether the door is locked or unlocked.

A second embodiment of the invention is shown in FIGS. 6 through 10 of the drawings. In this embodiment, the invention is applied to a door lock arrangement with a key mechanism on the inside surface of the door and also on the outside surface of the door. In this embodiment, a plate 60 is positioned in spaced relationship to the outside surface of the door 62 by tubular spacers 64. Screws 66 extend through the spacers and engage the door. A slotted disk 68 is positioned on one side of the plate 60 and is pinned through an opening to a gear 69. The slot in the disk 68 permits insertion of the key into the lock mechanism when the slot is aligned with the keyhole. The gear 69 engages gear 70 that is positioned on one end of shaft 72 with shaft 72 journaled in plate 60. The gear 69 has a slot which aligns with the slot in the disk 68 to permit access of the key into the lock. The slot in the disk 68 is indicated at 76. A housing 74 is disposed over the assembly and includes a circular opening 78 which is large enough to accommodate the key when it is rotated.

Figure 7:
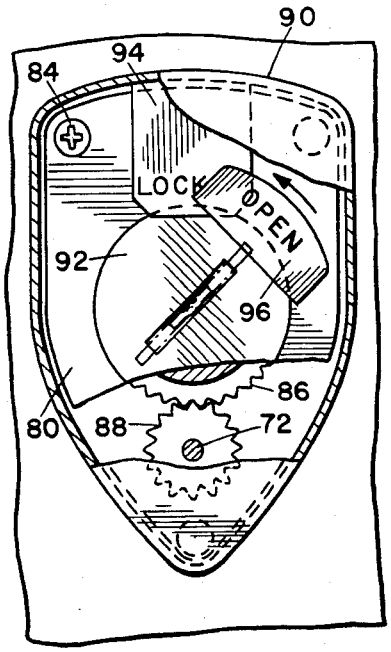
FIG. 7 is a view similar to FIG. 6, with the cover cut away and showing the moving flag action.
Figure 8:
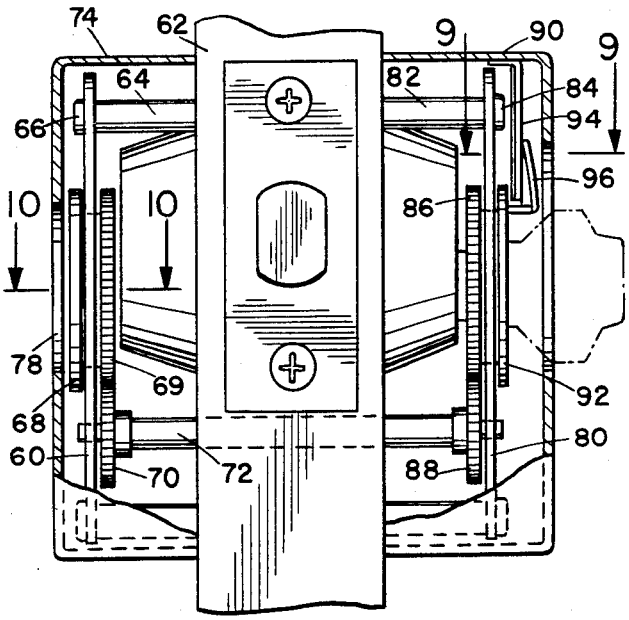
FIG. 8 is an end view as taken from the left hand side of FIG. 6, with the covers cut away.
Figure 9:
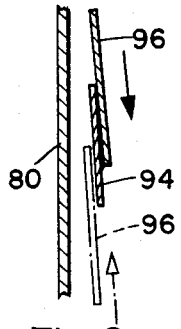
FIG. 9 is a sectional view taken on line 9—9 of FIG. 8, showing the moving flag action.
Figure 10:
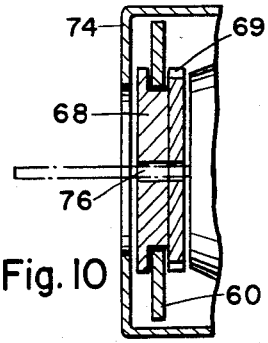
FIG. 10 is a sectional view taken on line 10—10 of FIG. 8.

A similar arrangement is located on the inside of the door surface with plate 80, spacers 82, screws 84, gear 86, gear 88 disposed on the other end of shaft 72, cover 90 and disk 92. FIG. 7 shows the construction of the assembly on the inside surface of the door with the cover 90 partly broken away. The cover 90 has an indicator tag 94 extending downwardly therefrom with the word "lock" thereon. The disk 92 has a flag 96 with the word "open" thereon. As shown in FIG. 9, the tag 94 and and flag 96 are canted so that the flag 96 passes under the tag 94 when rotated to the opened position and passes over the tag 94 when rotated to the locked condition. This canted arrangement accurately reflects the condition of the door lock even when the key is rotated to the neutral position.

Figure 11:
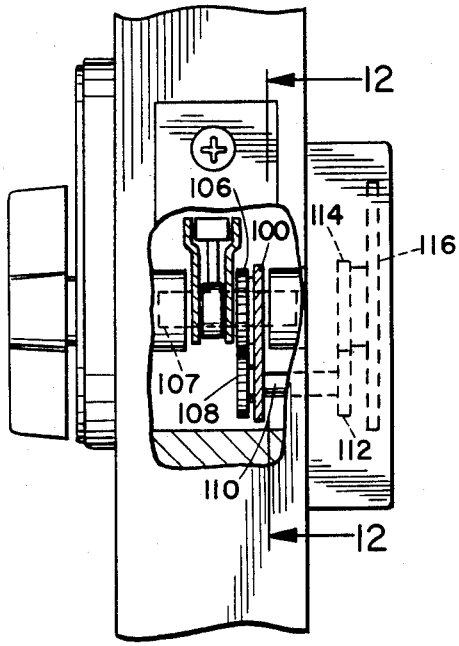
FIG. 11 is an end view, partially cut away, of an alternative indicator mechanism incorporated in the lock.
Figure 12:
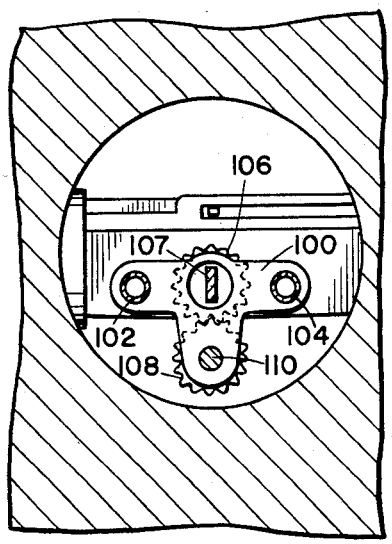
FIG. 12 is a sectional view taken on line 12—12 of FIG. 11.

A third embodiment of the invention is shown in FIGS. 11 and 12 of the drawings wherein the conventional lock mechanism is modified to contain the flag assembly. The external construction is a key and an actuating bar mechanism with the internal workings modified. A T-shaped bracket 100 is mounted over the existing lock spacers 102 and 104. A gear 106 mates with gear 108. Gear 106 is keyed onto the existing actuating bar 107 of the lock mechanism. Gear 108 is positioned on shaft 110 and gears 112 and 114 actuate the flag mechanism indicated generally at 116. The flag mechanism can be constructed as described previously herein.

The embodiments of the invention demonstrated are self-contained at the lock location. These embodiments define a unitized construction. As used herein, "unitized" is defined to mean a self-contained arrangement located at the lock location as an integral part of the lock mechanism.

The present invention allows the user of a cylinder lock deadbolt to readily distinguish the status of the lock without having to make a hands on inspection. It is universal in nature in that it will adapt to various types of door locks. The back set of the lock cylinder from the edge of the door, the door thickness, the lock escutcheon depth, and the clearance between cylinders do not have to be taken into consideration. The unit can be mounted with the use of ordinary hand tools and requires no special setups.

Having thus described our invention, we claim:

1. A unitized door lock with indicator, said door lock having means to lock and unlock the lock for use in conventional doors in the usual manner as with a key or thumb turn comprising:

a mounting plate having stationary indicator means and having an opening displaying the condition of the lock as either "open" or "locked";

moveable indicator means showing through an opening in the mounting plate and havig thereon indicia indicating either "open" or "locked", said moveable indicator means being activated automatically by activating means such as a key or thumb turn, whether activated from inside or outside of the door;

wherein movement of the lock actuating means in one direction indicates one condition of the lock by exposing the indicia on said stationary indicator means, and movement of the lock actuating means in another direction indicates the other condition of the door lock by covering the indicia on the stationary indicator means;

an attachment assemby for attaching to the door lock on the inside surface of the door, said assembly including an actuating member connected to the door lock actuating means for locking and unlocking the door and for moving the moveable indicator means;

wherein the moveable door lock indicator means includes gripping means extending from the door for gripping by the user and connected to the door actuating means for locking and unlocking the door lock;

wherein the stationary indicator means and the moveable indicator means are arranged so that the moveable indicator means passes over a fixed indicator means in one direction and under it in another direction to indicate the locked condition or unlocked condition of the door lock even when the lock is in the neutral position.

2. A unitized door lock with indicator, said door lock having means to lock and unlock the lock for use in conventional doors in the usual manner such as with a key or with a thumb turn comprising:

a mounting plate having stationary indicator means and having an opening displaying the condition of the lock as either "open" or "locked";

moveable indicator means showing through an opening in the mounting plate and having thereon indicia indicating either "open" or "locked", said moveable indicator means being actuated automatically by activating means such as a key or thumb turn, whether activated from inside or outside the door;

wherein movement of the lock actuating means in one direction indicates one condition of the lock by exposing the indicia on said stationary indicator means, and movement of the lock actuating means in another direction indicates the other condition of the door lock by covering the indicia on the stationary indicator means;

an attachment assembly for attaching to the door lock on the inside surface of the door, said assembly including an actuating member connected to the door lock actuating means for locking and unlocking the door and for moving the moveable indicator means;

wherein the moveable door lock indicator means includes gripping means extending from the door for gripping by the user, and connected to the door actuating means for locking and unlocking the door lock;

wherein the stationary indicator means and the moveable indicator means are arranged so that the moveable indicator means passes over the fixed indicator means in one direction and under it in another direction to indicate the locked condition or unlocked condition of the door lock even when the lock is in the neutral position; and wherein the moveable indicator means rotates with respect to the fixed indicator means and at least one of said indicator means is canted with respect to the other indicator means.

3. A unitized door lock with indicator according to claim 2 wherein one of said indicator means has resilience so that it accommodates the relative movement of the other indicator means.

4. A unitary door lock with indicator according to claim 3 wherein:

the moveable indicator means has resilience.

5. A unitized door lock with indicator, said door lock having means to lock and unlock the lock for use in conventional doors in the usual manner with a key inserted in a keyhole on either side of the door, comprising:

a mounting plate having stationary indicator means and having an opening displaying the condition of the lock as either "open" or "locked";

moveable indicator means showing through an opening in the mounting plate and having thereon indicia indicating either "open" or "locked", said moveable indicating means being actuated automatically by activating means such as a key, whether activated from inside or outside of the door;

wherein the movement of the lock actuating means in one direction indicates one condition of the lock exposing the indicia on said stationary indicator means, and movement of the lock activating means in another direction indicates the other condition of the door lock by covering the indicia on the stationary indicator means;

a first adapter plate means positioned on the outer surface of the door adjacent to the keyhole of the lock;

first rotary means positionable on said first adapter plate means and rotatable by the key as the key is rotated in the door lock;

motion transmission means connectable to said first rotary means and extending through the door from the outer surface of the door to the inner surface of the door;

second adapter means positioned on the inside surface of the door adjacent the keyhole of the door lock;

second rotary means positionable on said second adapter plate means and connectable with said motion transition means;

said second rotaray means including the second moveable indicator means and said second adapter plate includes said first stationary indicator means; and wherein the moveable indicator means has resilience and is canted with respect to said fixed indicator means.

* * * * *

UNITED STATES PATENT AND TRADEMARK OFFICE

CERTIFICATE OF CORRECTION

PATENT NO. : 4,490,999

DATED : January 1, 1985

INVENTOR(S) : NIAL K. CASTLE, DERALD E. MARTIN AND RALPH D. MARTIN

It is certified that error appears in the above-identified patent and that said Letters Patent are hereby corrected as shown below:

Column 6, line 23, Claim 5, change "rotaray" to --rotary--.

Signed and Sealed this

*Fourteenth* Day of *May 1985*

[SEAL]

*Attest:*

DONALD J. QUIGG

*Attesting Officer* *Acting Commissioner of Patents and Trademarks*